US011864631B2

(12) United States Patent
Brown et al.

(10) Patent No.: US 11,864,631 B2
(45) Date of Patent: Jan. 9, 2024

(54) DOWNWARDS ABSORBING AND UPWARDS ACCOMMODATING FOOTWEAR HEEL

(71) Applicant: Worcester Polytechnic Institute, Worcester, MA (US)

(72) Inventors: Christopher A. Brown, Waterbury Center, VT (US); James J. Muller, Worcester, MA (US); Julia A. Dunn, Worcester, MA (US); Alexander R. Alvarez, Worcester, MA (US); Kyle R. Mudge, Worcester, MA (US); Rachael Naoum, Worcester, MA (US)

(73) Assignee: Worcester Polytechnic Institute, Worcester, MA (US)

( * ) Notice: Subject to any disclaimer, the term of this patent is extended or adjusted under 35 U.S.C. 154(b) by 183 days.

(21) Appl. No.: 16/568,684

(22) Filed: Sep. 12, 2019

(65) Prior Publication Data

US 2020/0077736 A1 Mar. 12, 2020

Related U.S. Application Data

(60) Provisional application No. 62/730,194, filed on Sep. 12, 2018.

(51) Int. Cl.

| | |
|---|---|
| ***A43B 13/18*** | (2006.01) |
| ***A43B 21/26*** | (2006.01) |
| ***A43B 7/32*** | (2006.01) |

(52) U.S. Cl.

CPC ..... *A43B 7/32* (2013.01); *A43B 13/181* (2013.01); *A43B 21/26* (2013.01)

(58) Field of Classification Search

CPC ..... A43B 3/0042; A43B 7/32; A43B 13/181; A43B 13/185; A43B 21/26; A43B 21/32

See application file for complete search history.

(56) References Cited

U.S. PATENT DOCUMENTS 3,195,685 A 7/1965 Blackstone
3,834,046 A * 9/1974 Fowler ..... A43B 13/181 36/28

(Continued)

FOREIGN PATENT DOCUMENTS

GB 2 264 627 A 9/1993
GB 2492864 A 1/2013

(Continued)

OTHER PUBLICATIONS

International Search Report, PCT/US2019/050758, dated Dec. 5, 2019, pp. 2.

*Primary Examiner* — Sharon M Prange

(74) *Attorney, Agent, or Firm* — Armis IP Law, LLC

(57) ABSTRACT

A force dissipating device in a footwear appliance includes an actuator responsive to a displacement force from a shoe sole surface, and an elastic field of resilient, compressible material. The elastic field is elongated in a direction aligned with the displacement force, and an inclined surface is attached to the actuator and disposed against the elastic field. The actuator is adapted for movement parallel to the elastic field, while the inclined surface is oriented to compress the elastic field in a direction defined by the inclined surface. The inclined surface is oriented at an angle to compress the elastic field in a direction substantially perpendicular to vertical actuator displacement, thus providing a constant region of opposed, compressive force that is generally constant, rather than increasing with displacement distance.

13 Claims, 2 Drawing Sheets

(56) References Cited

U.S. PATENT DOCUMENTS

| | | | | |
|---|---|---|---|---|
| 4,187,620 | A * | 2/1980 | Selner | A43B 13/182 36/28 |
| 4,616,431 | A * | 10/1986 | Dassler | A43B 13/181 36/28 |
| 4,999,931 | A * | 3/1991 | Vermeulen | A43B 13/185 36/153 |
| 5,502,901 | A | 4/1996 | Brown | |
| 5,595,003 | A * | 1/1997 | Snow | A43B 13/181 36/27 |
| 5,661,927 | A | 9/1997 | Polowinczak et al. | |
| 6,378,169 | B1 | 4/2002 | Batten et al. | |
| 6,516,539 | B2 * | 2/2003 | Nishiwaki | A43B 7/1465 36/28 |
| 6,684,531 | B2 | 2/2004 | Rennex | |
| 7,013,581 | B2 | 3/2006 | Greene et al. | |
| 7,036,245 | B2 * | 5/2006 | Russell | A43B 7/1415 36/29 |
| 7,153,560 | B2 * | 12/2006 | Hofmann | A43B 1/0009 428/178 |
| 7,954,257 | B2 * | 6/2011 | Banik | A43B 13/184 36/28 |
| 8,261,469 | B2 | 9/2012 | Aveni et al. | |
| 9,179,733 | B2 * | 11/2015 | Peyton | A43B 13/148 |
| 9,339,074 | B2 | 5/2016 | Ellis | |
| 9,693,605 | B2 | 7/2017 | Beers | |
| 9,730,486 | B2 | 8/2017 | Brown et al. | |
| 10,244,821 | B2 | 4/2019 | Elder et al. | |
| 2010/0122471 | A1 | 5/2010 | Edington et al. | |
| 2015/0040435 | A1 | 2/2015 | Barnes et al. | |
| 2017/0325543 | A1 | 11/2017 | Iuchi et al. | |
| 2018/0042339 | A1 | 2/2018 | Barnes et al. | |
| 2018/0140043 | A1 | 5/2018 | Farris et al. | |
| 2018/0271211 | A1 | 9/2018 | Perrault et al. | |
| 2020/0077743 | A1 * | 3/2020 | Brown | A43C 15/161 |

FOREIGN PATENT DOCUMENTS

| | | | |
|---|---|---|---|
| KR | 1020100107721 | A | 10/2010 |
| WO | WO 2007/044451 | A1 | 4/2007 |
| WO | 2012045512 | A1 | 4/2012 |
| WO | 2012059142 | A1 | 5/2012 |

* cited by examiner

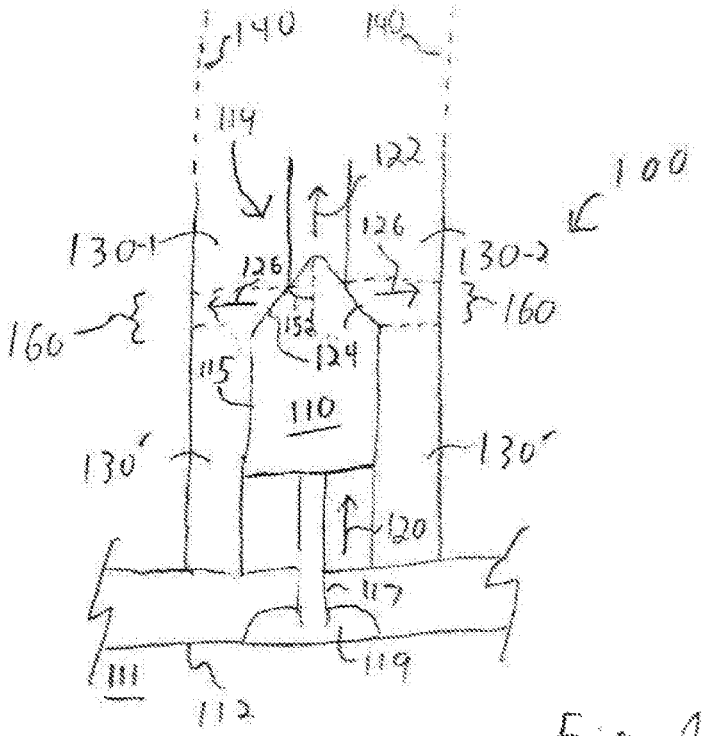
Fig. 1
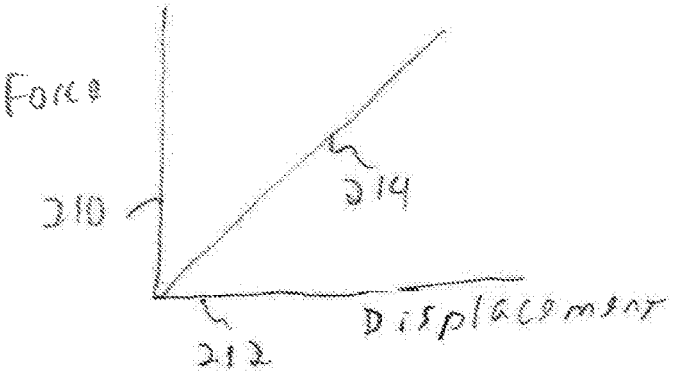
(Prior Art) Fig. 2
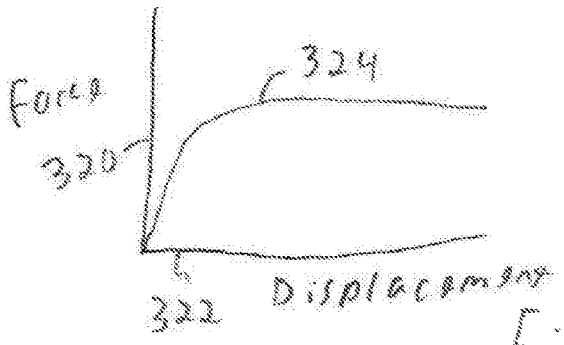
Fig. 3

DOWNWARDS ABSORBING AND UPWARDS ACCOMMODATING FOOTWEAR HEEL

RELATED APPLICATIONS

This patent application claims the benefit under 35 U.S.C. § 119(e) of U.S. Provisional Patent App. No. 62/730,194, filed Sep. 12, 2018, entitled "DOWNWARDS ABSORBING AND UPWARDS ACCOMMODATING FOOTWEAR HEEL," incorporated herein by reference in entirety.

BACKGROUND

Athletic injuries, such as from overstressed musculoskeletal structures, can be traumatic and career ending. ACL (anterior cruciate ligament) injuries are particularly notorious and prone to recurrence. These and other injuries often result from some form of loads (e.g., forces and torques) transferred through the footwear of the athlete to the foot and on to an anatomical member, such as, a bone, ligament, cartilage, tendon or other tissue structure. Mitigation of the transfer of these loads can substantially eliminate or alleviate injury risk to the foot, ankle, lower leg and knee. Because an athlete's footwear defines the ground interface, the footwear defines the focal point of potentially injurious load transfers. Protruding cleats are often used on the bottom of shoes used sports played on fields, grass, turf or dirt. These protrusions increase the load transfer from the athletes to the playing surface and can, unmitigated, raise the loads to those that can cause injury.

SUMMARY

A force mitigation approach for a footwear appliance defines an interface between a shoe upper and a shoe sole having a planar sole surface. A force dissipating device in the footwear appliance includes an actuator responsive to a displacement force from the shoe sole surface, and an elastic field of resilient, compressible material. The elastic field is elongated in a direction aligned with the displacement force, and an inclined surface is attached to the actuator and disposed against the elastic field. The actuator is adapted for movement parallel to the elastic field, while the inclined surface is oriented to compress the elastic field in a direction defined by the inclined surface. In response to actuator displacement adjacent to and parallel to the elastic field, the inclined surface is oriented at an angle to compress the elastic field in a direction perpendicular to actuator displacement, thus providing a constant region of opposed, compressive force that is generally constant, rather than increasing with displacement distance.

Configurations herein are based, in part, on the observation that the human foot receives and transfers all forces generated from ambulatory activity, including walking, running as well as higher intensity athletics. Unfortunately, conventional footwear suffers from the shortcoming of little to no capability to temper or disperse the upward forces transferred to the ankle, legs and spine from the downward movement of the foot onto the walking or running surface. Many conventional shoes employ rigid materials including wood and hard rubber, and even running sneakers, promoted as adapted to handle the impact of running, employ only some form of foam or air cushioning. Despite these features, substantial loads are still transferred up the leg, particularly from the heel, which typically has proportionally less cushioning than the toe region based on the magnitude of the loads incurred. Accordingly, configurations herein employ a constant force heel spring which provides a mitigating counterforce to upward heel loads. The constant force distributes the received force over time so that a peak impact is "leveled," avoiding a sharp peak force that causes orthopedic issues. In contrast, even with cushioning in conventional shoes, the load response is a spring reaction where the counterforce increases with distance, and still imposes a substantial peak force. The use of a constant force spring implemented as an elastic field against a constant displaced area absorbs peak forces with a constant counterforce rather than a variable force leading to a peak counterforce.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIG. 1 is a side cutaway view of the force dissipation device;

FIG. 2 is a graph of prior art force displacement performance;

FIG. 3 is a graph of a constant force spring response as defined herein;

DETAILED DESCRIPTION

Figure 4:
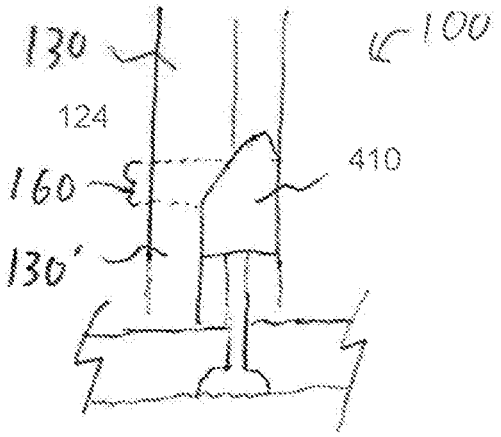
FIG. 4 is an alternate configuration of the elastic field of FIG. 1.

The description below presents an example of a footwear appliance, or shoe, for implementing the disclosed force mitigation device using a constant force, or substantially constant force spring structure for mitigating harmful transmission of downward forces or impact though shoe soles. The assembly including the constant force spring implements an elastic field approach where a counterforce is based on an area of the engaged elastic field, rather than an entire length of an elongated or contracted spring. The disclosed elastic field spring for exerting a constant force response is also applicable in alternate contexts without departing from the claimed approach.

FIG. 1 is a side cutaway view of the force dissipation device. Referring to FIG. 1, the force dissipation device 100 adapted for use in the heel of a footwear appliance includes an actuator 110 responsive to a displacement force 120 from a shoe sole surface 112. The actuator 110 engages with an elastic field 130-1, 130-2 (130 generally) of resilient, compressible material. The elastic field 130 is elongated in a direction 122 aligned with the displacement force 120, and generally defines a layer in a circular or rectangular arrangement to correspond to the actuator 110. A forward end 114 of the actuator 110 defines an inclined surface 124 attached to the actuator 110 and disposed against the elastic field 130. The actuator 110 is adapted for movement parallel to the elastic field 130 in longitudinal direction 122 such that the inclined surface 124 is oriented to compress the elastic field in a direction 126 defined by the inclined surface 124. In an example configuration as in FIG. 1, the inclined surface 124 is oriented at an angle 152 that directs a component of the displacement force 120 perpendicularly into a plane 140 defined by the elongated orientation of the elastic field 130 for opposing the displacement force 120. As the actuator 110 advances, the inclined surface 124 slidably engages and compresses the foam, rubber or resilient material as the inclined surface "wedges" the elastic field along the side 115 of the actuator 110 as it advances.

The actuator 110 is adapted for displacement adjacent to and parallel to the elastic field 130. The inclined surface 124 is oriented to compress the elastic field 130 in the direction 126 perpendicular to actuator displacement 120. The displacement force 120 results from a downward force of the shoe sole surface 112 against a ground surface 111, and the elastic field 130 is disposed to exert a counterforce against the inclined surface 124 in response to the displacement force 120 exerted on the actuator 110. A linkage 117 and pedestal 119 may complete the force transmission path to the sole surface 112. On a downward stride resulting from running or walking, as the foot/shoe contacts the ground surface 111, the displacement force 120 transfers to the actuator 110 which travels upward, as the inclined surface 124 at the forward edge 114 of the actuator 110 movement forces and compresses the elastic field 130 based on the angle 152.

The elastic field 130 imposes a resistance to the displacement force 120 in a load region 160 defined by an area of the elastic field opposed from the inclined surface 124. In contrast to conventional approaches where a resilient or spring material is subject to increasing compression, the angle 152 results in a constant compression region 160 based on the area of the inclined surface as the elastic field 130 is attains a compressed depth 130' or thickness. Accordingly, the compressing elastic field 130 defines a constant force spring as it transitions to the compressed 130' state so that the counterforce remains substantially constant, rather than increasing tantamount to an impact peak or point as with conventional springs.

FIG. 2 is a graph of prior art force displacement performance. In a conventional spring approach, a force 210 of an extended spring increases with the displacement 212 of the spring (line 214). An increasing level of force is required to continue displacement of an object connected to the spring, and a complementary return force is encountered upon release.

FIG. 3 is a graph of a constant force spring response as defined herein. The elastic field 130, in contrast to the spring of FIG. 2A, defines a constant force spring such that the force 320 required for displacement 322 remains substantially constant over the displacement distance, graphed as line 324 (following an initial compression period). With reference to the assembly in FIG. 1, the elastic field 130 imposes a resistance to the displacement force 120 in a load (compression) region 160 defined by the area of the elastic field 130 opposed from the inclined surface 124.

Since the area of the inclined surface 124 remains constant, the same volume of the elastic field 130 is being compressed at any given displacement, therefore the return force remains substantially constant. Displacement of the inclined surface 124 across the elastic field 130 therefore defines a constant force.

Referring to FIGS. 1-3, conventional footwear includes cushioning, air bladders and foam structures that behave similar to the conventional spring of FIG. 2. Compression, or downward force, is met with a counterforce that increases with the distance already displaced. In other words, once the foam or resilient heel material is compressed to a certain degree, it cannot further compress to any significant degree and imposes a counterforce more like an impact. In contrast, by disposing the inclined surface 124 across the elastic field 130, the inclined surface defines a constant compression region 160 based on an area of the elastic field responsive to compression from displacement of the inclined surface 124. Although the compression region 160 travels with the actuator 110, the area under the inclined surface subject to compression remains constant. In this manner, the inclined surface 124 counters the displacement force 120 with a counterforce proportional to the compressed area of the elastic field 130. The portion of the elastic field which has already been compressed 130' does not exert a continued force as do conventional approaches. A small to negligible fictional element may persist against the sides 115 of the actuator 110, which can be offset through material selection and surface treatment such as lubricants and other friction reducing approaches.

FIG. 4 is an alternate configuration of the elastic field of FIG. 1. Referring to FIGS. 1 and 4, the elastic field 130 and inclined surface 124 may take a variety of forms, such as linear, circular or opposed surface as shown in FIG. 1. In FIG. 4, an actuator 410 has only a single inclined surface 124, instead of the two opposed inclined surfaces of FIG. 1. Any suitable arrangement or definition of the elastic field 130 may be employed for engagement with an actuator 110 having a surface inclined at an angle for compressing and advancing along the elastic field. Generally, the inclined angle is oriented substantially around 45 degrees from the displacement force 120 direction, and thus oriented at the same angle with respect to actuator 110 travel.

Figure 5:
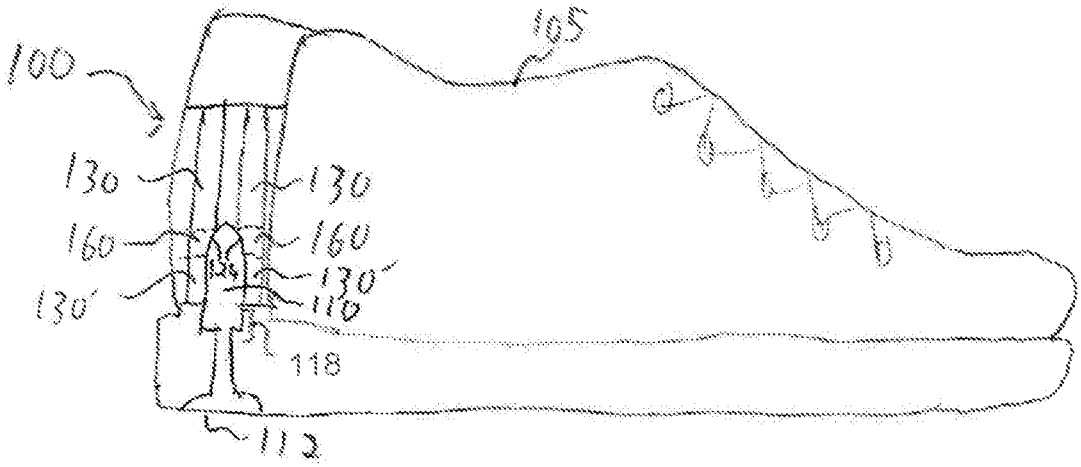
FIG. 5 shows the force dissipation device disposed in a shoe assembly.

FIG. 5 shows the force dissipation device disposed in a shoe assembly 105. The shoe assembly 105 of FIG. 5 may be any type of footwear, including performance athletic sneakers intended for high impact activity, walking/running shoes, or other suitable application were downward ambulatory forces tend to be telegraphed though the shoe to the lower skeletal region. Force absorption and dissipation occurs iteratively with the stride and/or pace of play, such that the actuator 110 returns to a rest or undeployed position after upward travel mitigated by the elastic field 130. In general, when deployed in the shoe assembly 105, the elastic field 130 is engaged with the inclined surface 124 for returning the displaced actuator 110 based on the elastic field expanding to an uncompressed state. Such movement is effected by a natural reversal and tendency of the elastic field 130 to expand to an uncompressed state. The actuator 110 may extend beyond the elastic field 130 by a distance 118 to accommodate movement of the actuator 110 without allowing the elastic field to re-expand or "bunch up" behind the actuator 110 after movement.

Figure 6:
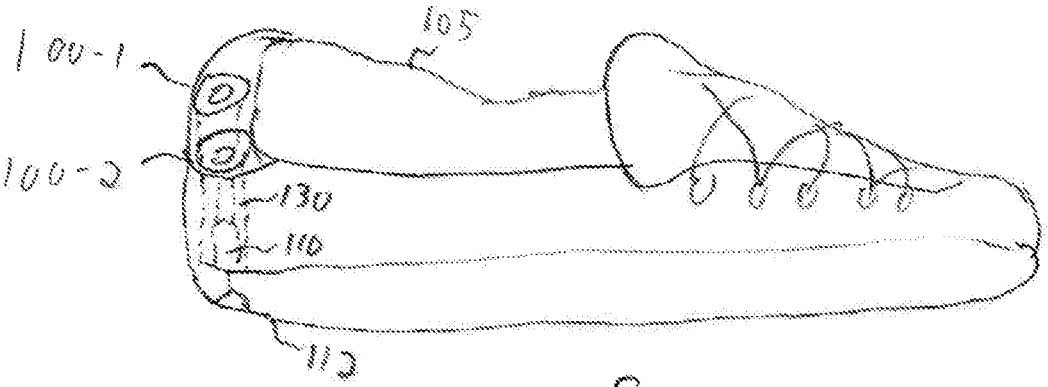
FIG. 6 shows a perspective view of alternate arrangement of the elastic field of FIGS. 1 and 4-5.

FIG. 6 shows an alternate arrangement of the elastic field of FIGS. 1 and 4-5. Referring to FIGS. 5 and 6, a plurality of force dissipation devices 100-1 . . . 100-2 may be deployed in an article of footwear, with an expected focus on the heel region as the majority of forces as well as an accommodating space for the devices 105 are localized here. A circular form factor, such that the actuator 110 defines a parabolic or "torpedo" shape may be implemented in a tubular elastic field 130. Other suitable form factors may be envisioned to utilize available spacing in a heel region of a footwear appliance.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A force dissipating device in a shoe assembly, comprising:

an actuator responsive to a displacement force from a shoe sole surface;

an elastic field of resilient, compressible material, the elastic field disposed in a heel region of the shoe assembly, the elastic field extending above a top of the sole surface, the top of the sole surface configured to directly bear a load of a wearer of the shoe assembly, the elastic field elongated in a direction aligned with the displacement force; and an inclined surface attached to the actuator and disposed against the elastic field, the actuator adapted for movement adjacent to and parallel to the elastic field, the inclined surface oriented to compress the elastic field in a direction perpendicular to actuator displacement by slidably engaging and compressing the elastic field in the perpendicular direction to the actuator movement above the sole surface;

the elastic field disposed to exert a counterforce against the inclined surface, the counterforce based on a volume of a compression zone defined by an area of the elastic field engaging the inclined surface, in response to the displacement force exerted on the actuator.

2. The device of claim 1 wherein the displacement force results from a downward force of the shoe sole surface against a ground surface.

3. The device of claim 2 wherein the elastic field is engaged with the inclined surface for returning the displaced actuator based on the elastic field expanding to an uncompressed state.

4. The device of claim 1 wherein the inclined surface defines a constant compression region based on an area of the elastic field responsive to compression from displacement of the inclined surface.

5. The device of claim 4 wherein the inclined surface counters the displacement force with a counterforce proportional to the compressed area of the elastic field.

6. The device of claim 1 wherein the inclined surface is oriented at an angle that directs a component of the displacement force perpendicularly into a plane defined by the elastic field for opposing the displacement force, the component of the displacement force parallel to the sole surface.

7. The device of claim 6 wherein the inclined angle is oriented substantially around 45 degrees from parallel to the sole surface.

8. The device of claim 7 wherein the elastic field imposes a resistance to the displacement force in a load region defined by an area of the elastic field opposed from the inclined surface.

9. The device of claim 1 wherein the elastic field further comprises a plurality of opposed elastic fields, the inclined surface further comprising a respective inclined surface corresponding to each of the opposed elastic fields.

10. The device of claim 1, wherein the elastic field and the inclined surface each define a circular shape.

11. The device of claim 1 wherein the displaced actuator experiences a force based on an area of a constant compression region between the inclined surface and the elastic field.

12. The device of claim 1 wherein the elastic field defines an open circular form extending above the top of the sole surface.

13. A method for mitigating harmful or detrimental forces in a shoe assembly, comprising:

disposing an actuator from a shoe sole surface responsive to downward forces from ambulatory activities, the actuator responsive to a displacement force from the shoe sole surface;

engaging an inclined surface on the actuator with an elastic field of resilient, compressible material, the elastic field elongated in a direction aligned with the displacement force, the elastic field disposed in a heel region of the shoe assembly, the elastic field extending above a top of the sole surface, the top of the sole surface configured to directly bear a load of a wearer of the shoe assembly; and disposing the inclined surface against the elastic field, the actuator adapted for movement adjacent to and parallel to the elastic field, the inclined surface oriented to compress the elastic field in a direction perpendicular to actuator displacement by slidably engaging and compressing the elastic field in the perpendicular direction to the actuator movement above the sole surface;

the elastic field disposed to exert a counterforce against the inclined surface, the counterforce based on a volume of a compression zone defined by an area of the elastic field engaging the inclined surface, in response to the displacement force exerted on the actuator.

* * * * *